US005950754A

United States Patent [19]

Ondrish, Jr.

[11] Patent Number: 5,950,754

[45] Date of Patent: Sep. 14, 1999

[54] MULTI-TERRAIN RIDING BOARD

[76] Inventor: Albert J. Ondrish, Jr., 2451 Sykesville Rd., Westminster, Md. 21157

[21] Appl. No.: 09/119,526

[22] Filed: Jul. 21, 1998

Related U.S. Application Data

[60] Provisional application No. 60/053,454, Jul. 22, 1997.

[51] Int. Cl.[6] ..... A63C 5/08

[52] U.S. Cl. ..... 180/181; 180/180

[58] Field of Search ..... 180/180, 181, 180/216; 280/87.041, 87.042, 87.01, 11.2, 842, 841, 89

[56] References Cited

U.S. PATENT DOCUMENTS

| | | | |
|---|---|---|---|
| 1,397,311 | 11/1921 | Benbow et al. | 280/89 |
| 4,054,297 | 10/1977 | Solimine | 280/87.04 |
| 4,069,881 | 1/1978 | Shiber . | |
| 4,073,356 | 2/1978 | Schlicht . | |
| 4,094,372 | 6/1978 | Notter . | |
| 4,143,728 | 3/1979 | Shiber . | |
| 4,555,122 | 11/1985 | Harvey | 280/87.041 |
| 4,573,549 | 3/1986 | Pankow | 180/216 |
| 5,020,621 | 6/1991 | Martin . | |
| 5,048,632 | 9/1991 | Battel | 180/181 |
| 5,127,488 | 7/1992 | Shanahan . | |
| 5,169,166 | 12/1992 | Brooks | 280/87.042 |
| 5,330,214 | 7/1994 | Brooks et al. | 280/87.042 |
| 5,381,870 | 1/1995 | Kaufman . | |
| 5,474,314 | 12/1995 | Lehman | 280/87.042 |
| 5,513,865 | 5/1996 | Brooks et al. | 280/87.042 |
| 5,551,717 | 9/1996 | Milne | 280/87.042 |

FOREIGN PATENT DOCUMENTS 2225990 6/1990 United Kingdom .

OTHER PUBLICATIONS

ExtremeToys, Randal Motor Boards, 1997, web site: www.extremetoys.com Physical, Inc., TUFPRO G–BOARD, 1997, web site: www.Biwako.or.jp/ Physical/ tufpro.html Mountain Board Sports, Inc., MBS, 1997, web site: www-.mountainboard.com TSI Powered Sports, Inc., All–Terrain Board, 1997, web site: www.poweredsports.com.

LandSurfer, Land Surfer, 1997, web site: www.landsurfer-.com Motoboard International, MOTOBOARD, 1997, web site: www.motoboard.com.

*Primary Examiner*—Lanna Mai
*Assistant Examiner*—Jeff Restifo

[57] ABSTRACT

A multi-terrain riding board includes an elongate deck mounted on a chassis, a front axle assembly pivotally coupled with the chassis and including a pair of horizontal spindles rotatable about respective vertical axes, a pair of wheels mounted for rotation about the spindles, a pair of tie rods connected between the chassis and the spindles to transfer tilting movement of the chassis into rotation of the spindles about the vertical axes, a rear axle coupled with the chassis, and a rear wheel rotatably mounted on the rear axle. In one embodiment, the rear axle is fixedly connected to the chassis so that the rear wheel cambers in response to angulation of the deck; however, the rear axle can be pivotally coupled with the chassis and provide with a pair of spindles and tie rods to steer like the front axle assembly if desired. Preferably, horizontal tension springs are connected between the spindles and a bottom portion of the chassis to help stabilize the deck of the riding board. An engine or motor can be mounted within the chassis between the front and rear axle assemblies, in which case the deck is preferably hingedly connected with the chassis to permit pivotal movement of the deck from a lowered position resting on the chassis to an elevated position allowing access to the engine.

20 Claims, 10 Drawing Sheets

MULTI-TERRAIN RIDING BOARD

CROSS-REFERENCE TO RELATED APPLICATIONS

This application claims the benefit of U.S. Provisional Application Ser. No. 60/053,454, filed on Jul. 22, 1997, the disclosure of which is incorporated herein by reference.

BACKGROUND OF THE INVENTION

1. Field of the Invention

The present invention relates generally to riding boards and, more particularly, to motorized riding boards for off-road, multi-terrain use.

2. Description of the Relevant Art

Conventional riding boards, such as skateboards, typically include an elongate horizontal deck supported at opposite ends by pairs of small, solid wheels. Such riding boards are usually propelled by a combination of gravity and the body movements of the rider. The wheels are usually mounted on trucks which are designed to cause the wheels to turn somewhat in response to angulation of the deck or board such that the rider may steer the riding board by laterally shifting his or her weight.

The popularity of conventional skateboards has given rise to a desire to mount an engine or motor. Most often, such motors have been mounted on conventional skateboards, however, these motorized skateboards are not suitable for use on rough and hilly surfaces due in part to their relatively small, hard wheels, their low ground clearance, the relatively small and underpowered motors used, and their lack of suitable steering over rough and hilly surfaces and over, around and through obstacles in the path of intended movement.

In some cases, as exemplified by U.S. Pat. No. 4,073,356 to Schlicht, U.S. Pat. No. 5,381,870 to Kaufman and by the Randal Motor Board™, the motors have been mounted above the deck with drive components protruding through or under the deck to propel the board thereby permitting somewhat larger motors to be used. A disadvantage of this type of motorized skateboard, however, is that the motor divides the deck thereby limiting movement of the feet and the types of stances that can be used as well as exposing the rider to potential injury from contact with the motor.

Other motorized skateboards, as exemplified by U.S. Pat. No. 4,094,372 to Notter, U.S. Pat. No. 4,069,881 and 4,143,728 to Shiber, U.S. Pat. No. 5,020,621 to Martin and U.S. Pat. No. 5,127,488 to Shanahan, mount the motor at the rear of the deck behind or over the rear wheels; however, this arrangement disturbs the overall balance of the skateboard and tends to expose portions of the motor as well as increasing the overall length of the skateboard and preventing the rider from being able to safely grab the rear edge of the deck in some maneuvers.

Recently, a number of all-terrain riding boards have been introduced as exemplified by the TUFPRO G-BOARD from Physical, Inc., of Nagahama-City Shiga, Japan, The all-terrain board from TSI Powered Sports, Inc., and the all-terrain boards from Mountain Board Sports. The all-terrain boards typically include three or four pneumatic tires mounted on relatively large diameter wheels underneath or around a standard skateboard deck to permit use on a variety of riding surfaces. The all-terrain boards from Physical and TSI Powered Sports are also available with motors which are mounted above the rear wheel of the board and protrude upwardly therefrom like some of the motorized skateboards described above.

SUMMARY OF THE INVENTION

Accordingly, it is a primary object of the present invention to overcome the disadvantages of the prior art and to provide an improved riding board capable of being used on rough and hilly surfaces with or without a motor.

It is another object of the present invention to increase ground clearance and improve steering and maneuverability of a riding board over rough and hilly terrain by mounting the deck of the riding board on a chassis pivotally connected to at least one axle assembly.

A further object of one aspect of the present invention is to facilitate unrestricted use of the deck of a motorized riding board and to minimize exposure of the rider to the engine by mounting the engine within a chassis beneath the deck of the riding board.

Still another object of one aspect of the present invention is to permit easy access to the engine for maintenance and adjustment by connecting the deck to the chassis with a hinge.

Some of the advantages of the present invention over the prior art are that larger and more powerful engines can be used with out reducing the surface area of the deck or elevating the center of gravity of the board, that stability over rough and hilly terrain is improved, and that the board can be made compact with a minimum of protruding parts that can catch on objects in the riding environment or otherwise injure or impede the activities of the rider.

A first aspect of the present invention is generally characterized in a riding board including an elongate deck mounted on a chassis, a front axle assembly pivotally coupled with the chassis and including a pair of spindles rotatable about respective vertical axes, a pair of wheels mounted for rotation about the spindles, a pair of tie rods connected between the chassis and the spindles to transfer tilting movement of the chassis into rotation of the spindles about their respective vertical axes, a rear axle coupled with the chassis, and a rear wheel rotatably mounted on the rear axle. In one embodiment, the rear axle is fixedly connected to the chassis so that the rear wheel cambers in response to angulation of the deck; however, the rear axle can be pivotally coupled with the chassis and provided with a pair of spindles and tie rods to steer like the front axle assembly if desired. Preferably, horizontal tension springs are connected between the spindles and the chassis to help stabilize the deck of the riding board.

A second aspect of the present invention is generally characterized in a riding board including front and rear wheel assemblies coupled with a chassis, an engine assembly mounted within the chassis between the front and rear wheel assemblies, and a board assembly with a substantially horizontal elongate deck mounted on the chassis above the engine assembly to provide a platform upon which a rider can stand and a hinge connecting the deck with the chassis at one end to permit an opposite free end of the deck to pivot from a lowered position resting on the chassis to an elevated position allowing access to the engine assembly. In a preferred embodiment, the board assembly further includes a mechanism for releasably latching the free end of the deck to the chassis in the lowered position.

Other objects and advantages of the present invention will become apparent from the following description of the preferred embodiments taken in conjunction with the accompanying drawings, wherein like parts and each of the several figures are identified by the same reference numerals or by reference numerals having the same last three digits.

DETAILED DESCRIPTION OF THE PREFERRED EMBODIMENTS

Figure 1:
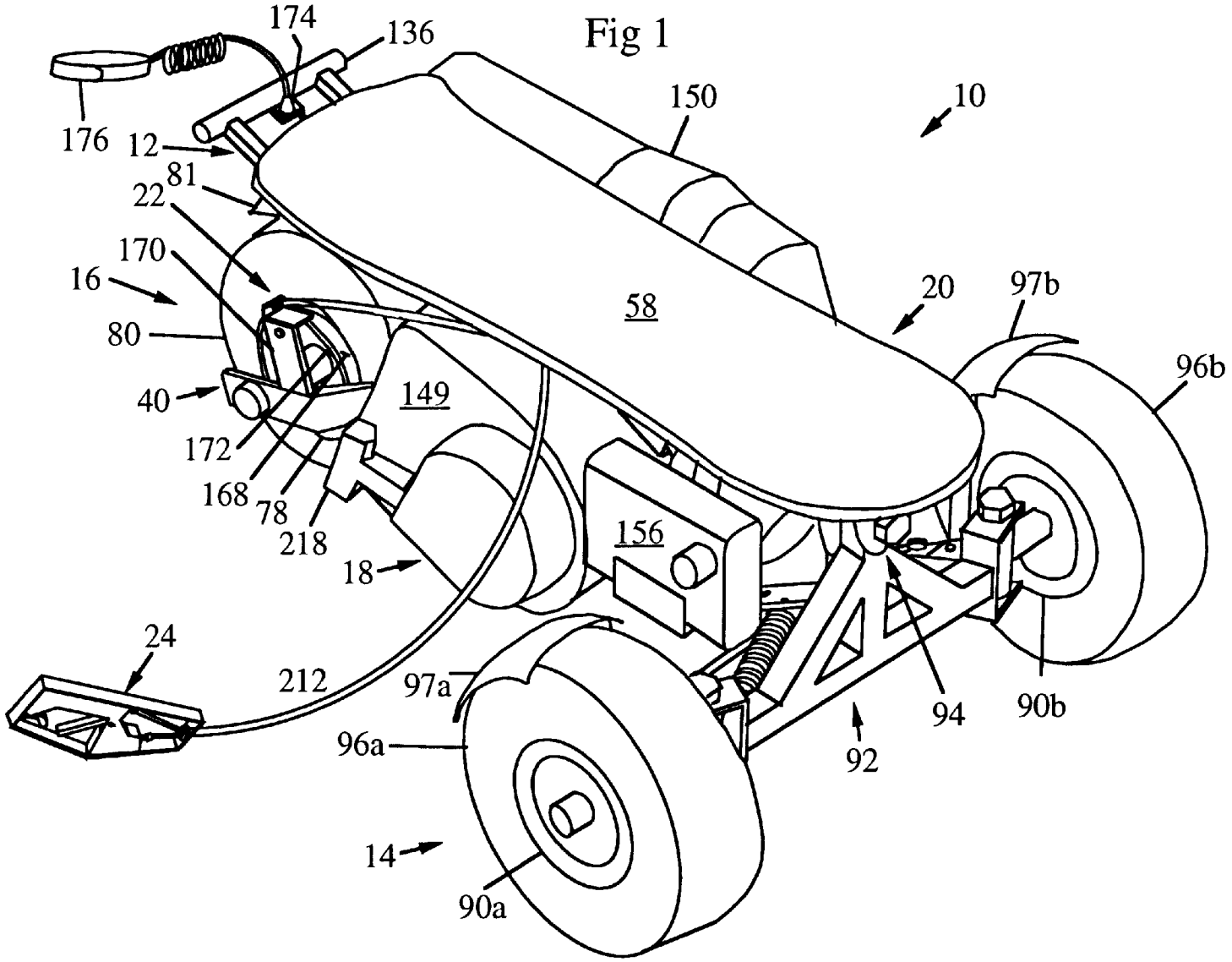
FIG. 1 is a front perspective view of the riding board according to the present invention in riding mode with the hinged board assembly in the lowered position.
Figure 2:
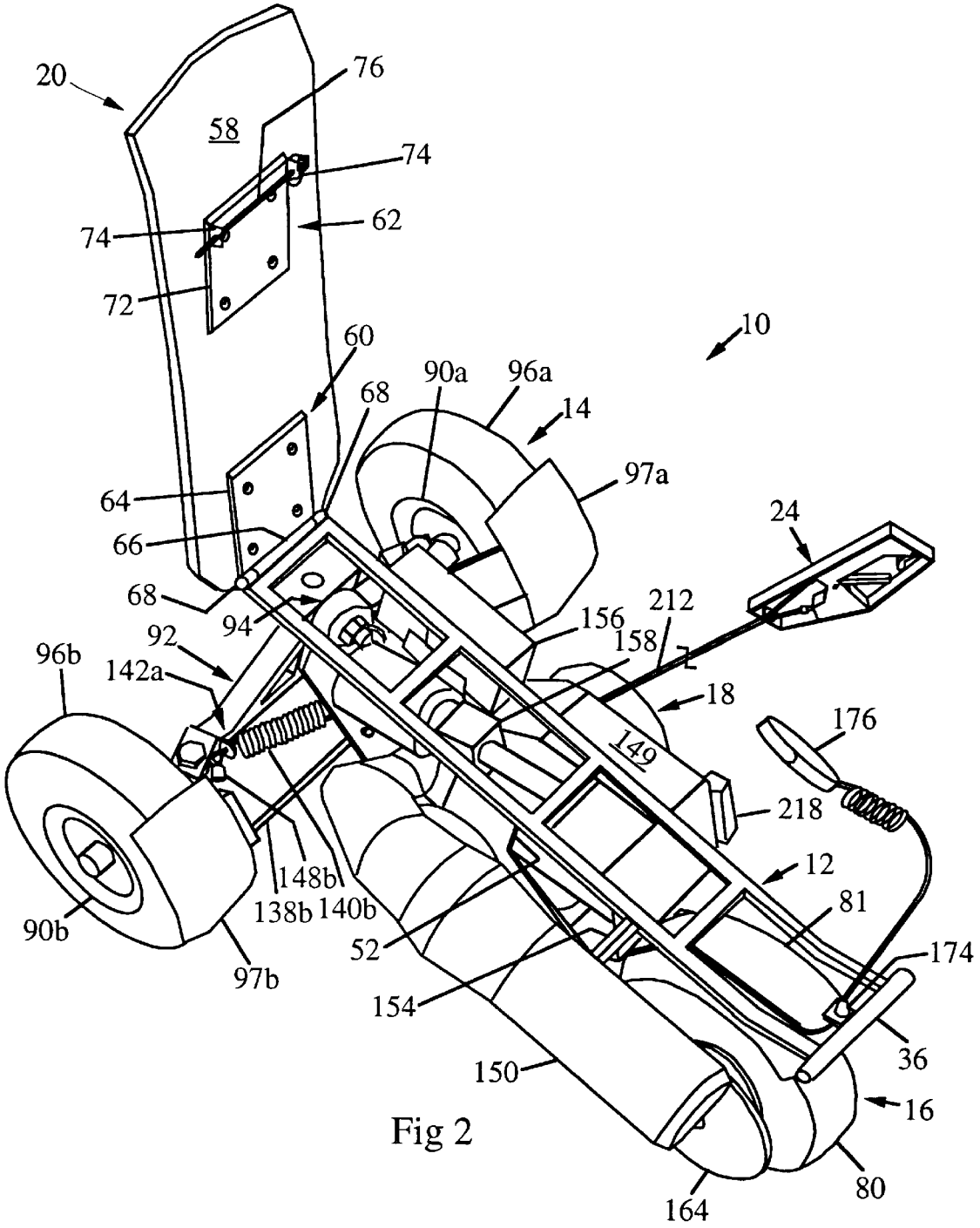
FIG. 2 is a rear perspective view of the riding board according to the present invention with the hinged board assembly in an elevated or raised position.

A riding board 10 according to the present invention, as illustrated in FIGS. 1–10, includes a chassis 12 rotatably mounted on front and rear wheel assemblies 14 and 16, an engine assembly 18 supported by the chassis, and a board assembly 20 hingedly attached to the chassis to define in a lowered or close position a surface upon which a rider can stand, as shown in FIG. 1, and to provide access to the engine assembly in a elevated or open position as shown in FIG. 2. The riding board further includes a braking mechanism 22 operatively connected with rear wheel assembly 16 and a hand control assembly 24 for controlling operation of the braking mechanism and engine assembly 18.

Figure 3:
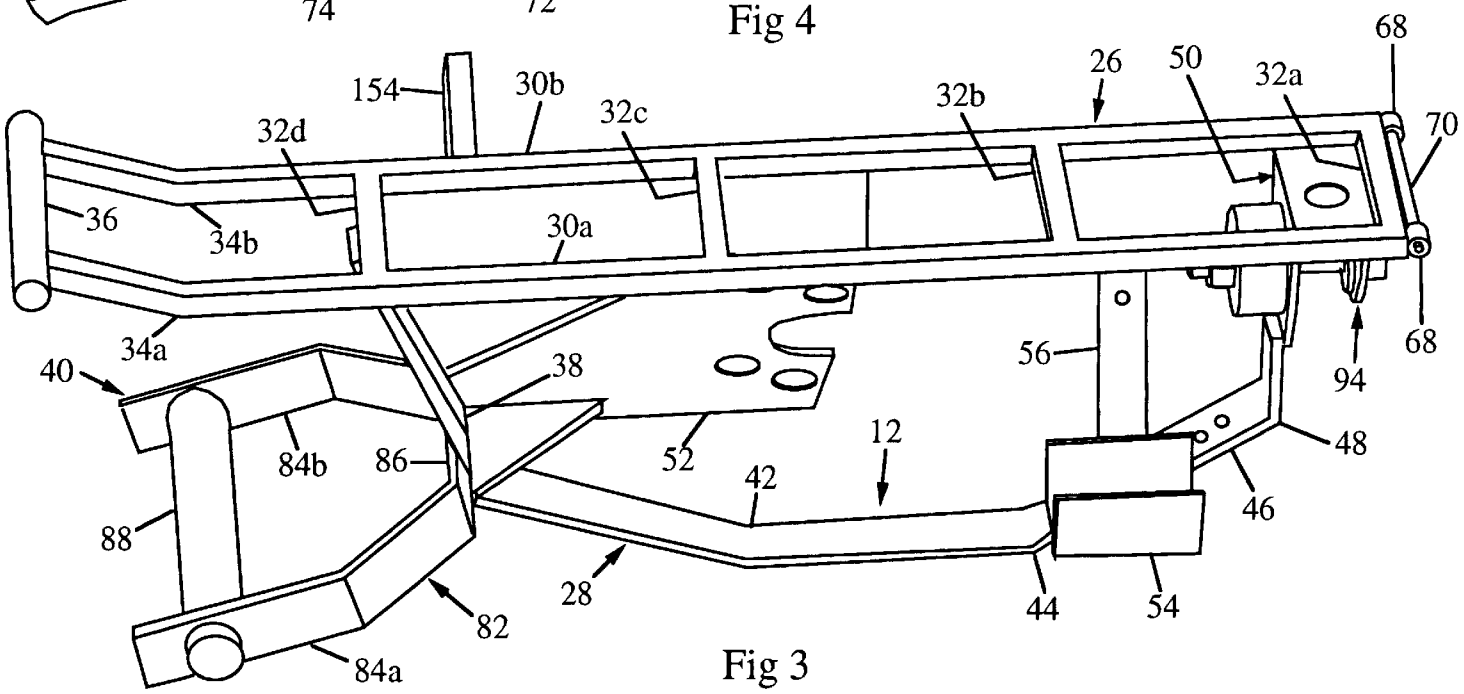
FIG. 3 is a right side perspective view of a rotatable chassis for use with the riding board according to the present invention.

Chassis 12 is shown in FIGS. 2 and 3 as a reinforced metal framework including top and bottom support structures 26 and 28, the top structure being formed of pair of spaced longitudinal members 30*a* and *b* connected at spaced intervals by a plurality of transverse cross-members 32*a, b, c* and *d,* the longitudinal and transverse frame members being formed of square metal tubing. The longitudinal frame members extend rearwardly from the rearmost cross-member 32*d* to bends 34*a* and *b* where the longitudinal members bend upwardly at an angle to connect with a handle 36 extending transversely between the longitudinal members, the handle being of generally cylindrical configuration to permit the rider to manually pull or lift the riding board when necessary.

As best seen in FIG. 3, bottom support structure is formed of flat, metal bar stock which extends downwardly from the center of rearmost cross-member 32*d* top support structure 26 to a first bend 38 where the bar connects with rear axle assembly 40. The bottom support structure extends forwardly from the rear axle assembly at a slight downward angle to a second bend 42 where the bottom support structure bends upwardly to define a generally horizontal portion, the generally horizontal portion extending forwardly from the second bend to a third bend 44 where the bottom support structure bends upwardly at an angle to define a lower front portion or support 46. The lower front portion of the bottom support structure extends upwardly at an angle from the third bend to a forth bend 48 from which the bottom support structure extends upwardly in a generally vertical direction to connect with the forward most cross-member 32*a* for the top support structure via a pivot saddle 50 described in greater detail below. Chassis 12 further includes an engine mount 52, shown in FIGS. 3 and 7 as a flat metal plate with mounting holes, extending downwardly from longitudinal frame member 30*b* to connect with bottom support structure 28 adjacent rear axle assembly 40, and a gas tank mounting bracket 54 of generally U-shaped configuration suspended from a hanger 56 formed of a thin strip of mental extending downwardly from longitudinal frame member 30*a* adjacent the front end of the chassis.

Figure 4:
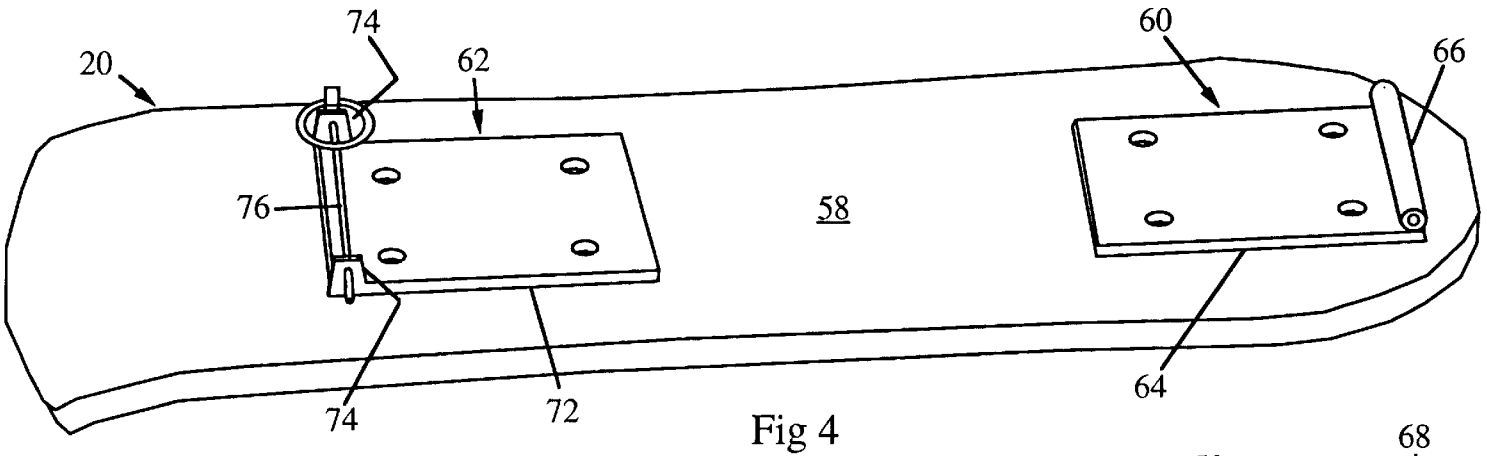
FIG. 4 is a bottom perspective view of the hinged board assembly showing a hinge component, linchpin bracket and linch pin.

As best seen in FIG. 4, board assembly 20 includes an elongate board or deck 58 of conventional design with a first component or half 60 of a piano hinge and a linchpin bracket 62 mounted underneath the board adjacent front and rear edges of the board, respectively. Hinge component 60 includes a mounting plate 64 of generally rectangular configuration secured to board 58 in a conventional manner, for example with wood screws, and a tubular hinge member 66 of generally cylindrical configuration extending transversely across the mounting plate to fit between laterally spaced tubular hinge members 68 on a front edge of the top support structure of chassis 12 when the board is placed on the chassis. A hinge pin 70 extends through tubular hinge members 66 and 68 allowing board 58 to pivot therabout between the closed or lowered position shown in FIG. 1 and the open or elevated position shown in FIG. 2. Linchpin bracket 62 includes a mounting plate 72 of generally rectangular configuration secured to board 58 in a conventional manner, for example with wood screws, and a pair of tabs 74 extending downwardly from lateral edges of the mounting plate to be disposed along opposite lateral edges of the top support structure of chassis 12 when the board is in the lowered position. A linchpin 76 can be inserted through aligned openings formed in tabs 74 to lock or latch the free end of board 58 in the lowered position and may be manually removed from the tabs to permit the free end of the board to be raised upwardly or pivoted about the hinged end of the board. In the lowered position, board assembly 20 provides and unencumbered riding surface allowing the rider to utilize any type of stance and permitting unrestricted movement of the feet while riding. In the elevated position, board assembly 20 provides easy access to engine assembly 18, as well as other components of the riding board, for maintenance, adjustments and servicing. A storage container or compartment (not shown) can also be provided within chassis 12 or on a bottom surface of board assembly 20 to store small items or tools.

Referring again to FIGS. 1 and 3, rear wheel assembly 16 includes a rear wheel 78 with a pneumatic tire 80 mounted on rear axle assembly 40 and a fender 81. Rear axle assembly 40 includes a rear wheel mount 82 of generally U-shaped configuration having a pair of spaced, parallel legs 84*a* and *b* extending rearwardly from a base portion 86 transversely connecting the legs, the base portion being fixedly attached to the bottom support structure of chassis 12 adjacent first bend 38. Rear axle 88 extends transversely between the legs of the rear wheel mount.

Figures 5, 6:
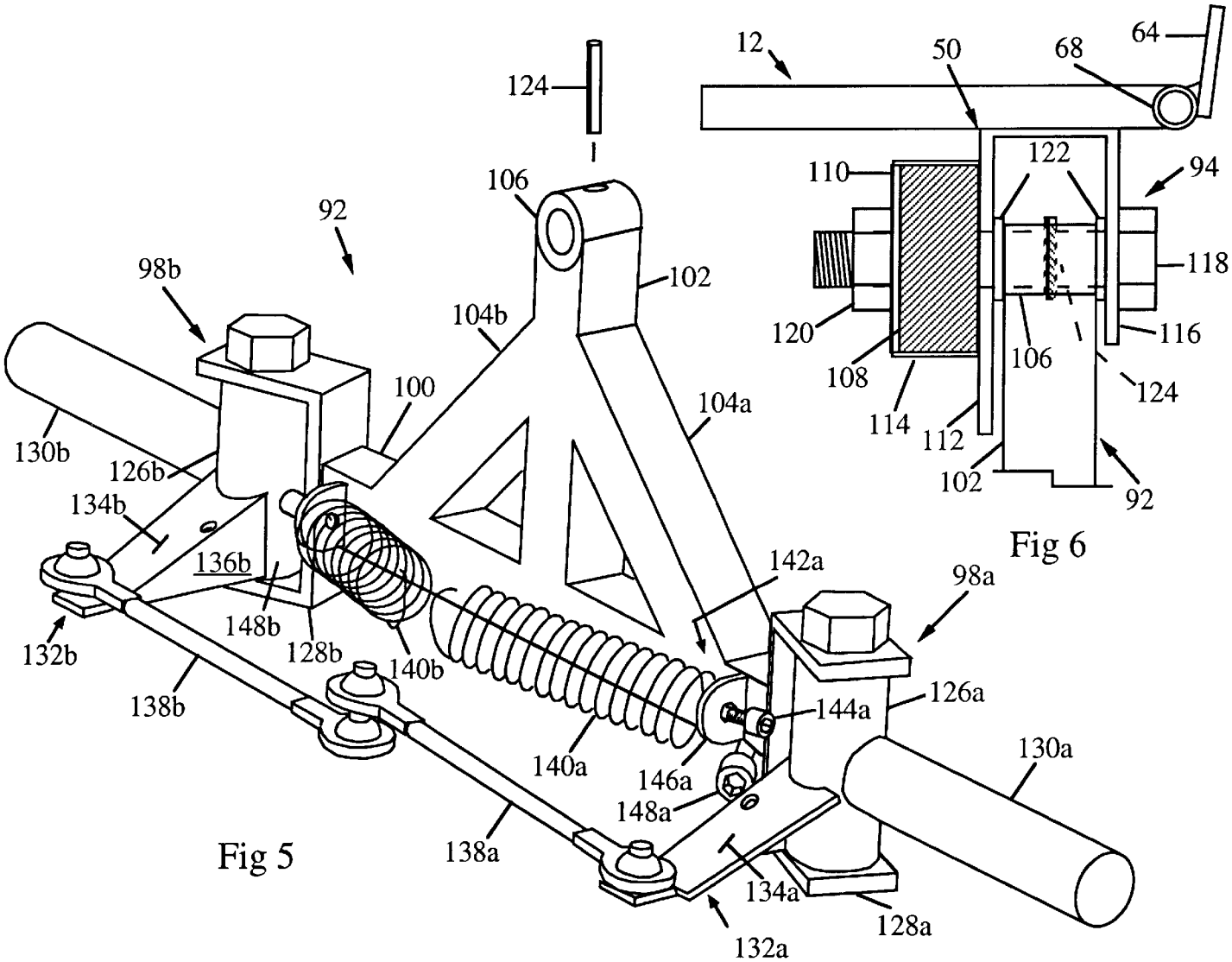
FIG. 5 is a back perspective view of a front axle assembly for use with a riding board according to the present invention.
FIG. 6 is an enlarged fragmentary view of a pivot assembly for use with a riding board according to the present invention.
Figure 7:
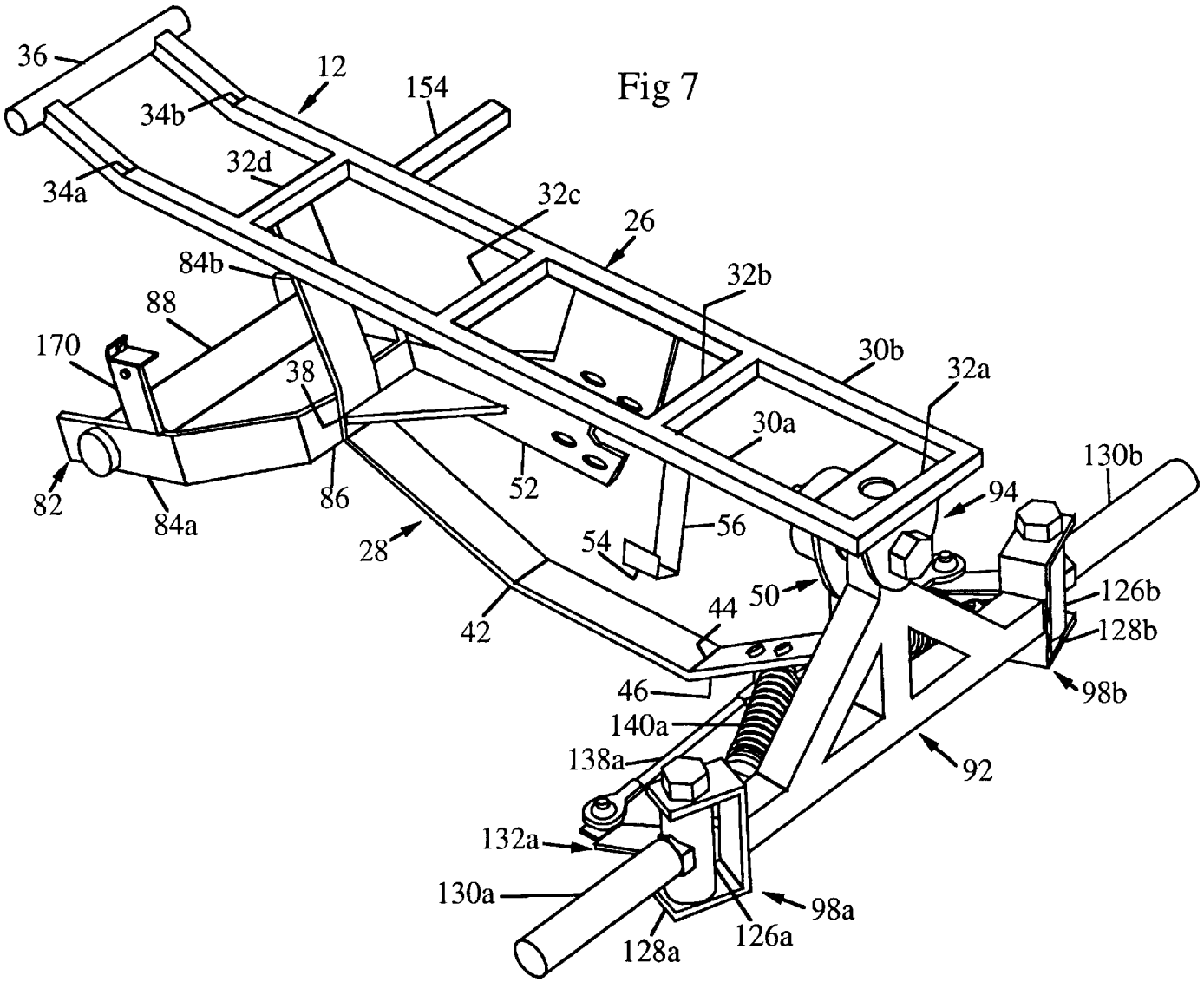
FIG. 7 is a front perspective view showing the rotatable chassis and front axle assembly coupled via the pivot assembly.

Front wheel assembly 14 includes a pair of laterally spaced front wheels 90*a* and *b* mounted on a front axle assembly 92 pivotally connected with chassis 12 via a pivot assembly 94. Front wheels 90*a* and *b* are similar to rear wheel 78 and include pneumatic tires 96*a* and *b* and fenders 97*a* and *b,* respectively. As best seen in FIG. 5, front axle assembly 92 includes right and left spindle assemblies 98*a* and *b* connected by a horizontal support member 100, a vertical support member 102 extending perpendicularly upward from the center of the horizontal support member, and a pair of diagonal support members 104*a* and *b* extending between the vertical and horizontal support members at an acute angle to stiffen the front axle assembly and provide reinforcement allowing a longer vertical support member to be used. The vertical, horizontal and diagonal support members of the front axle assembly are shown formed of square metal tubing but can be solid if desired or have any other suitable shape or configuration. Vertical support member 102 terminates vertically at a hollow tubular end or sleeve 106 of cylindrical configuration oriented perpendicular to the vertical axis in alignment with the longitudinal axis of the board.

As best seen in FIG. 6, pivot assembly 94 includes a pivot saddle 50 of generally U-shaped configuration having front and rear walls 116 and 112 extending downwardly from the front end of chassis 12, a rubber bushing 108 disposed between an end plate 110 and the rear wall of the pivot saddle, and a housing 114 of hollow, cylindrical configuration extending circumferentially around the end plate and the bushing. Tubular end 106 of the front axle assembly is received between front and rear walls 116 and 112 of the pivot saddle and is held in place by a bolt 118 extending through an opening in the front wall 116 of the pivot saddle, through the front axle assembly and an opening in the rear wall 112 of the pivot saddle, the pivot bolt extending through bushing 108 and end plate 110 to be received by a lock nut 120. Spring pin 124 extends through an opening in the top and bottom of tubular end 106 and corresponding openings in pivot bolt 118 to rigidly attach the pivot bolt 118 to the front axle assembly. Tubular end 106 of the front axle assembly is held in compression between front and rear walls 116 and 112 of the pivot saddle by tightening lock nut 120, the compressive forces being applied to the front axle assembly via machine bushings 122 at opposite axial ends of the tubular end of the front axle assembly 92. Tightening lock nut 120 on pivot bolt 118 presses the bushing housing end plate 110 against rubber bushing 108 thereby compressing the rubber bushing against the interior of housing 114 and around the portion of the pivot bolt inside the bushing. Since front axle assembly 92 mounted in pivot saddle 50 is rigidly attached to pivot bolt 118, tightening lock nut 120 on the pivot bolt increases damping or, in other words, slows rotational movement of rotatable chassis 12 relative to the front axle assembly. Pivot assembly damping can be adjusted by tightening or loosening lock nut 120 and will typically be chosen by the rider as a function of the unevenness of the riding surface and the rider's weight and skill. For example, a rider may want to tighten the lock nut when riding on relatively smooth surfaces having few obstacles or loosen the lock nut when riding on rough or hilly surfaces requiring quicker turns to avoid closely spaced obstacles.

Spindle assemblies 98*a* and *b* are disposed at opposite ends of horizontal support member 100 of the front axle assembly and include swiveling posts 126*a* and *b* of cylindrical configuration oriented vertically within spindle brackets 128*a* and *b* of generally C-shaped configuration and spindles 130*a* and *b* extending transversely from the posts to carry front wheels 90*a* and *b,* respectively. A pair of lugs 132*a* and *b* extend rearwardly from swiveling posts 126*a* and *b,* respectively. A pair of lugs 132*a* and *b* extend rearwardly from swiveling posts 126*a* and *b,* respectively, and include a top side or surface 134*a* and *b* angled downwardly from the swiveling posts and inwardly facing sides or surfaces 136*a* and *b* of generally triangular configuration extending transversely from the top side of the lugs. Tie rods 138*a* and *b* are attached with universal-type swivel joints between the bottom support structure of chassis 12 and lugs 132*a* and *b,* respectively, to cause front wheels 90*a* and *b* to turn when the tie rods are moved by a rider leaning on board 58 and rotating chassis 12. Stabilization tension springs 140*a* and *b* extend horizontally between the bottom support structure of chassis 12 and a pair of adjustable mounts 142*a* and *b* at opposite ends of the horizontal support member of front axle assembly 92 adjacent the spindle assemblies. The adjustable mounts include screws 144*a* and *b* connected to springs 140*a* and *b* respectively, the screws threadedly engaging rearwardly extending plates 146*a* and *b* to permit the rider to control the tension of the springs by tightening or loosening the screws. The stabilization springs resist tilting of the rotatable chassis 12 thereby aiding the rider in returning the chassis to its normal, horizontal position of equilibrium when unintended turning of front wheels 90*a* and *b,* rotation of front axle assembly 92, or rotation of chassis 12 occurs. The stabilization tension springs work together, or in concert with, the pivot assembly damping discussed above. Steering turn radius adjusters 148*a* and *b* are mounted at opposite ends of the horizontal support member of front axle assembly 92 and are spaced inwardly of the spindle assemblies. The turn radius adjusters are shown as screws which threadedly engage the horizontal support member and are angled outwardly and in the path of rotation of lugs 132*a* and *b* to serve as a stop or abutment limiting the degree front wheels 90*a* and *b* can turn while steering and, consequently, the degree board 58 can rotate or lean. the degree of turn is determined by the length of screws 148*a* and *b* protruding from the horizontal support member and, accordingly, the rider can adjust the degree of turn by tightening or loosening screws 148*a* and *b,* the degree of turn being dependent upon the skill of the rider and the degree of safety desired.

Figure 8:
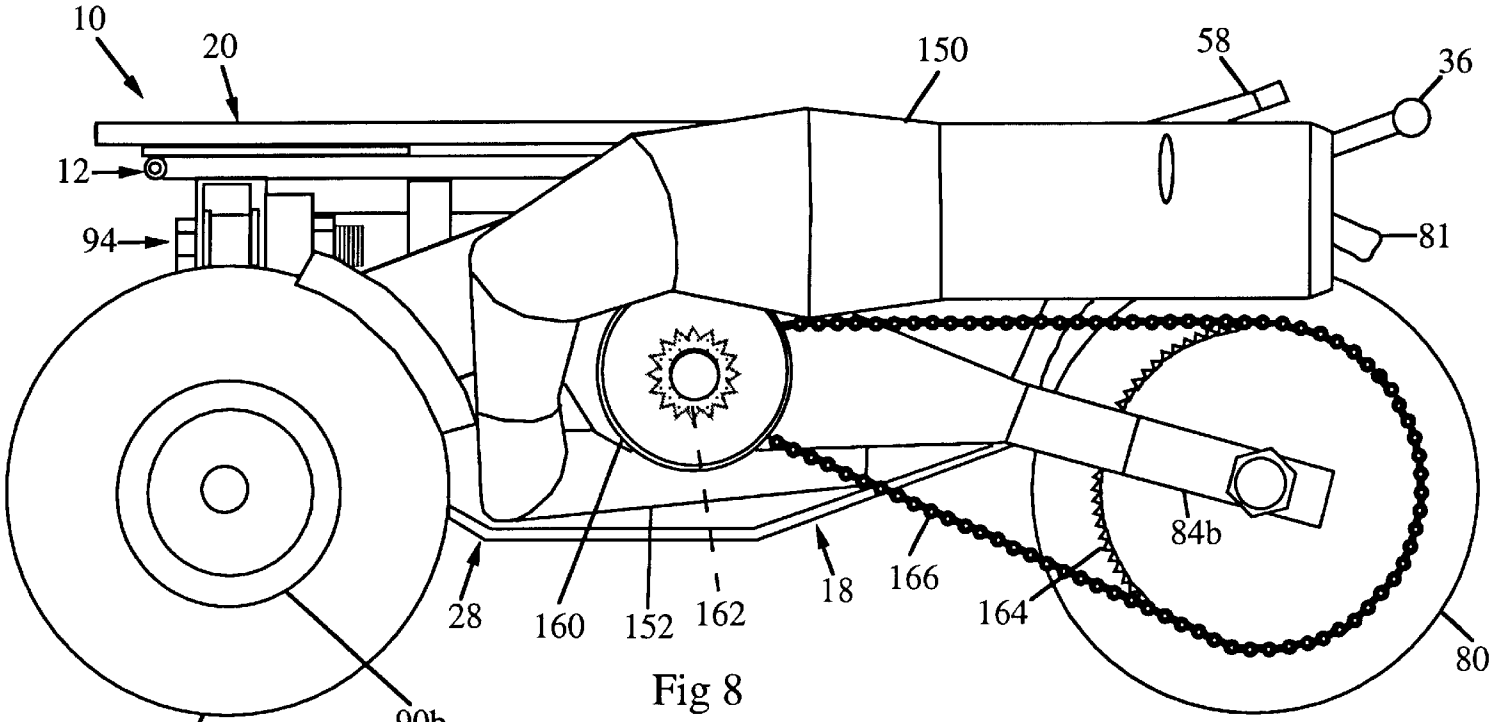
FIG. 8 is a left side view of the riding board according to the present invention illustrating drive components.
Figure 9:
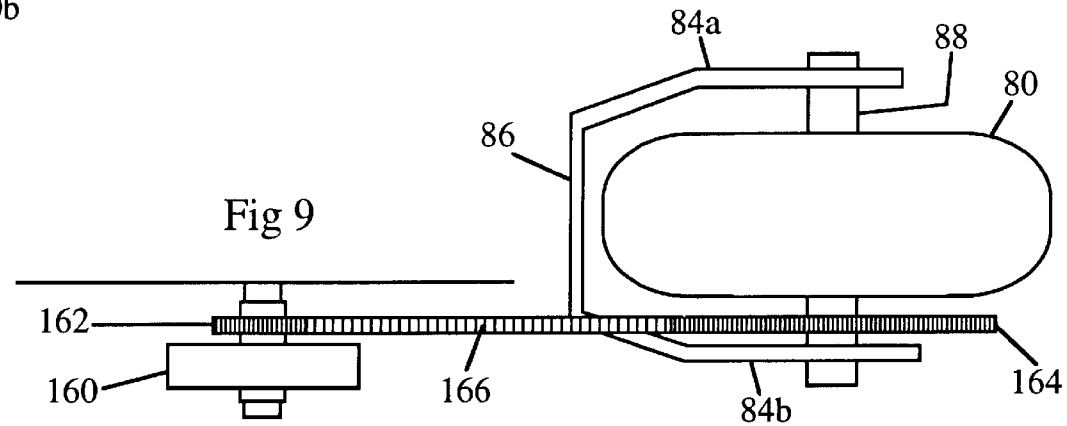
FIG. 9 is a fragmentary view of a centrifugal clutch and drive sprocket configuration for use with a riding board according to the present invention.

Referring now to FIGS. 8 and 9 in particular, engine assembly 18 is shown as including a commercially available 100 cc, 4 horsepower (h.p.), High-performance two cycle internal combustion engine 149 mounted below the hinged riding board 58 within rotatable chassis 12 utilizing the slotted holes of engine mount 52. An expansion pipe 150 extends upwardly from exhaust header 152 of the engine to a bend or elbow from which the exhaust pipe extends rearwardly to connect with a mount 154 extending laterally outward from the rotatable chassis. A gas tank 156, supported in mounting bracket 54 on the right side of the chassis looking forwardly, supplies fuel to a carburetor 158 disposed directly underneath the riding board. A centrifugal clutch 160 is disposed on the left side of engine 149 between expansion pipe 150 and engine mount 52, and is attached to the output shaft (not shown) of the engine. A first drive sprocket 162 is attached to centrifugal clutch 160 and is connected to a second drive sprocket 164 on rear wheel 78 via a continuous drive chain 166 thereby providing motive force for the riding board.

Referring again to FIG. 1, brake assembly 22 includes a conventional brake band 168 attached to brake mount 170 extending upwardly from rear wheel mount 82 and a brake drum 172 of conventional configuration which is attached to rear wheel 78 to provide a mechanism for braking or reducing the speed of the riding board when in use. An engine safety cut-off switch can be mounted at the rear of the rotatable chassis, as shown in FIG. 2, or anywhere else on the riding board to stop the engine when activation pin 174 connected to the ankle of the rider via tether 176 is pulled out. An optional toggle-type kill switch (not shown) can be mounted on the engine or at any other convenient location on the riding board to stop the engine.

Figure 10:
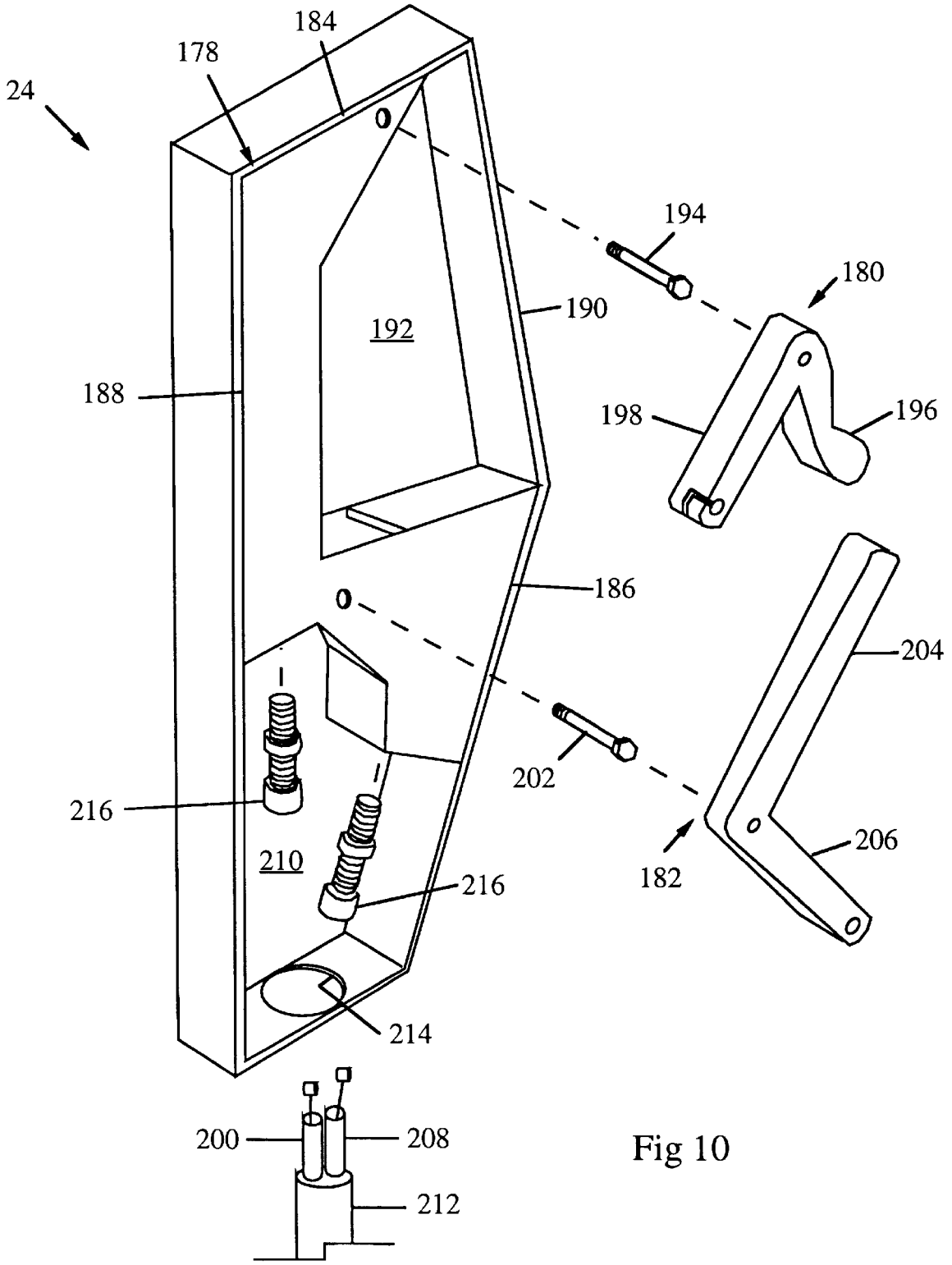
FIG. 10 is an exploded view of a hand-held, dual lever, throttle and brake control assembly with cable adjusters and an integrated hand guard.

As best seen in FIG. 10, hand control assembly 24 includes a hand control housing 178, mounting a throttle lever 180 and a brake lever 182. Housing 178 includes a main housing having top and bottom portions 184 and 186 of generally triangular configuration extending transversely from opposite axial ends of an elongate hollow gripping portion 188, and an integrated hand guard 190 connecting top and bottom portions of the main housing to define a fully enclosed finger opening 192 for protectively receiving the fingers of the rider when the main housing is gripped. Throttle lever 180 is generally L-shaped and is pivotally mounted on a pin or bolt 194 extending through pivot holes formed in the top portion of the main housing. A first leg 196 of throttle lever 180 is disposed within finger opening 192 while the second leg 198 of the throttle lever is enclosed within the top portion of the main housing. A throttle cable 200 is connected between the second leg of the throttle lever and carburetor 158 so that when the throttle lever is in a neutral, undepressed position, condition or state the engine will idle and when the throttle lever is pressed or pivoted in the clockwise direction, looking at FIG. 10, the engine will increase speed. When the throttle lever is released, the throttle lever will preferably pivot in the counterclockwise direction to the neutral position in response to a biasing force at the carburetor and/or a separate bias member (not shown) incorporated in the hand control assembly or other suitable location. Brake lever 182 is also generally L-shaped, but with somewhat longer legs providing increased mechanical advantage and a larger gripping surface to accommodate multiple fingers. The brake lever is pivotally mounted on a pin or bolt 202 extending through pivot holes formed in the bottom portion of the main housing, with a first leg 204 of the brake lever extending into the finger opening and the second leg 206 being enclosed within the bottom portion of the main housing. A brake cable 208 is connected between the second leg 206 of the brake lever and band brake 168 so that when the brake lever is in a neutral, undepressed position, condition or state the brake will not be engaged and when the first leg 204 of the brake lever is pressed, the brake lever will pivot about bolt 202 in the counterclockwise direction, looking at FIG. 10, causing brake drum 172 on rear wheel 78 to slow the wheel. When the first leg of the brake lever is released, the brake lever will preferably pivot in the clockwise direction to the neutral position in response to biasing force at the braking mechanism and/or a separate bias member (not shown) incorporated into the hand control assembly.

Hand guard 190 is shown defined by a metal strip or bar extending completely around the main housing and extending downwardly therefrom to define an access opening 210 below the main housing; it will be appreciated, however, that the hand control assembly can be provided without a hand guard or, if provided with a hand guard, the hand guard can be formed by a strip or bar extending only between top and bottom portions of the main housing or the hand guard can be formed with the main housing as an integral one-piece unit. Throttle and brake cables 200 and 208 are enclosed within a control cable sheath 212 having one end fixedly attached to the bottom of the hand control housing 178 and the other end terminating at brake mount 170 on the right side of rotatable chassis 12. It will be appreciated, however, that the control cable sheath can be routed out the front, rear or either side of the chassis as desired. The throttle and brake cables extend from the control cable sheath into access opening 210 via a hole or aperture 214 formed through the bottom of the hand control housing, the throttle and brake cables passing through conventional cable tensioners 216 disposed within the access opening to permit adjustment of the tension of the cables.

In use, board 58 is lowered to rest on chassis 12 and is locked in place by inserting linchpin 76 underneath the top support structure of the chassis and through tabs 74 to prevent upward movement of the free end of the board during use. Engine 149 is started by priming the engine (if necessary) and yanking a pull cord 218 on the right side of the riding board, looking forwardly, to cause the engine to idle. The rider may then mount deck or board 58 while holding hand control assembly 24 in either hand and with ankle tether 176 optionally being secured to one of the rider's ankles. The rider can cause riding board 10 to move forwardly by depressing throttle lever 180 of the hand control, thereby causing the engine speed to increase to a point where the friction surfaces of the centrifugal clutch automatically engage one another to transmit power to rear wheel 78 via sprockets 162 and 164 and drive chain 166 without the need for complicated and costly gear reduction. As the riding board is propelled forwardly, the rider may alter the direction of travel or steer the riding board by shifting their body weight to tilt the deck 58 thus causing chassis 12 to rotate about pivot assembly 94. Angulation or tilting of deck 58 and chassis 12 causes rear 78 to camber in the direction of angulation and, since tie rods 138*a* and *b* are attached to a bottom portion of the chassis below pivot assembly 94, the tie rods will move in a generally horizontal direction opposite the direction of angulation of the deck. For example, if the rider leans to the right while moving forwardly, tie rods 138*a* and *b* will move to the left with the bottom of chassis 12. The tie rods push and/or pull lugs 132*a* and *b* causing swivel posts 126*a* and *b* to rotate about their respective vertically oriented, longitudinal axes within brackets 128*a* and *b* thereby turning spindles 130*a* and *b* and, thus, front wheels 90*a* and *b* in the direction of angulation. Since the tie rods 138*a* and *b* are attached to a lower front portion 46 of chassis 12 spaced further from pivot assembly 94 than top portion 26, angulation of the deck about the pivot assembly through a given arc will result in movement of the tie rods in a larger arch such that steering responsiveness is improved. As a result, the rider can move easily and quickly avoid obstacles when riding off-road.

Angulation of the deck is resisted by pivot assembly 94 and horizontal stabilization springs 140*a* and *b* so that, when the rider encounters uneven or bumpy terrain, the springs will assist the rider in returning and maintaining the board in a stable, forwardly oriented direction. Since the springs are oriented substantially horizontally and connected between a bottom portion of the chassis and the front axle assembly, the stabilizing forces exerted by the springs on the chassis are vertically offset from pivot assembly 94 thus creating relatively large moment forces at the pivot assembly without the need for large, bulky springs. Excessive leaning and/or oversteering is prevented by adjustable steering mounts 148*a* and *b* which define a stop or abutment preventing the wheels from turning beyond a predetermined angle of rotation chosen by the rider. While riding the board 10, riders can adjust their foot positions, squat, grab edges of the board and otherwise move in an unencumbered fashion along the top of the board without fear of encountering an obstacle or injuring any part of their body through contact without moving parts of the engine assembly. Since the engine is disposed beneath the deck between the front and the rear wheel assemblies, the overall balance and feel of the board more closely approximates that of an unmotorized skateboard while the center of gravity of the riding board remains low to improve stability and maneuverability.

The riding board can be slowed or stopped by releasing throttle lever 180 of the hand control to cut power to the rear wheel and/or by depressing brake lever 182 of the hand control to operate the band brake. If the rider falls while riding the board, tether 176 attached to their ankle will activate the engine cut-off switch thereby cutting power to the rear wheel and causing the engine to shut off. If hand control 24 is released during use of the riding board, throttle lever 180 will preferably return to a neutral position causing the engine to idle rather than continuing to supply power to the rear wheel.

Deck 58 can be moved from the horizontal riding position shown in FIG. 1 to the elevated position shown in FIG. 2, e.g., to provide access to engine assembly 18, by removing linchpin 76 and lifting the free end of the deck away from the chassis. The deck will preferably remain in the elevated position until deliberately lowered by the rider, e.g., by allowing the deck to tilt forwardly of the chassis when elevated or by propping the board with a rod in an elevated position.

While the riding board described above is particularly advantageous when utilized with an engine assembly including a relatively large displacement, high horsepower internal combustion engine, it will be appreciated that any suitable engine can be used including, but not limited to, internal combustion engines of lower or greater displacement and horsepower and electrical motors. In a preferred embodiment, the engine assembly includes a 100 cc displacement, 2-cycle internal combustion engine generating about 4 HP. For more demanding activities, such as racing, an optional racing piston port engine can be used which generates about 11 HP.

Figure 11:
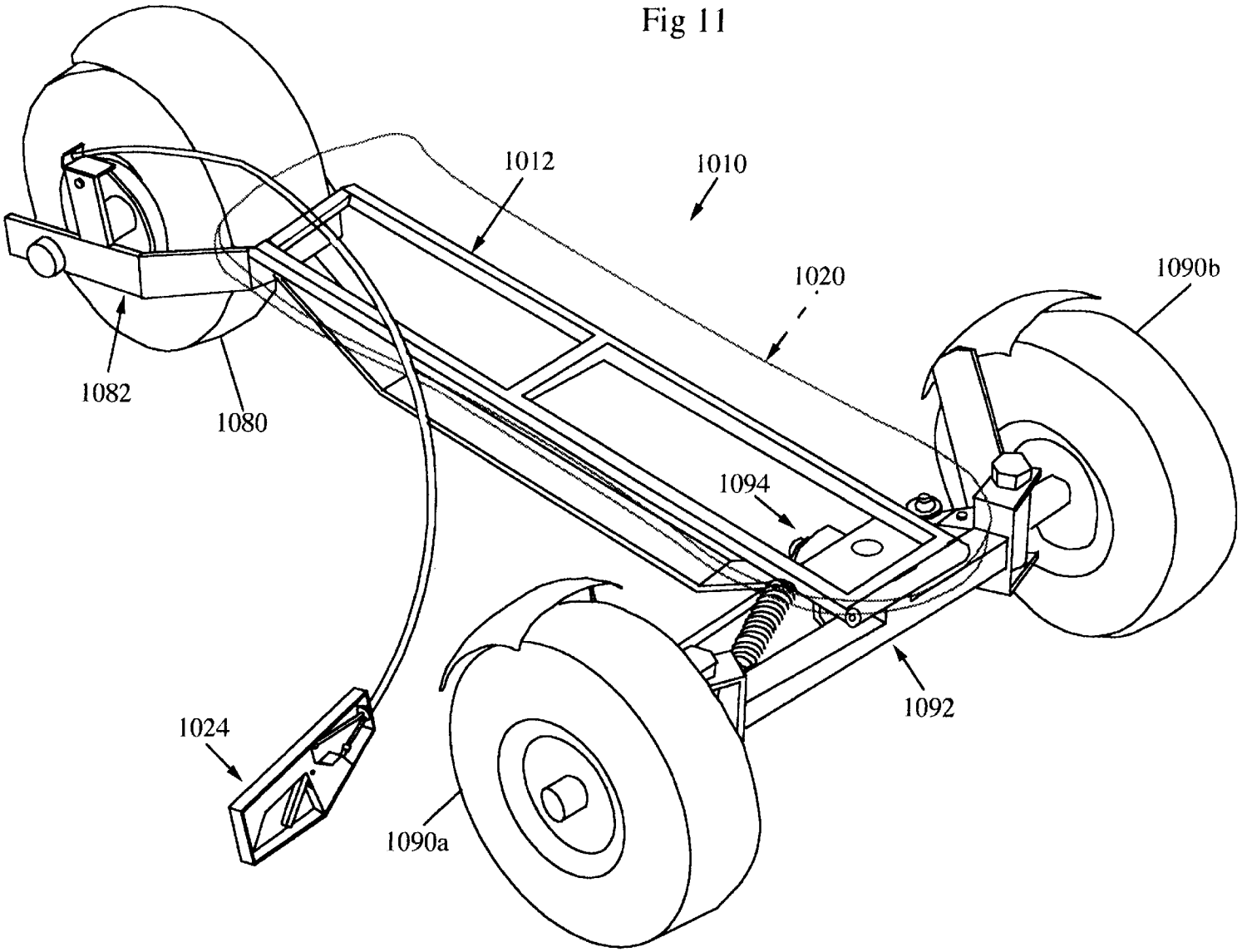
FIG. 11 is a front perspective view of a modification of the multi-terrain riding board according to the present invention.

The riding board can also be utilized advantageously without an engine assembly. For example, in FIG. 11, a modification of the riding board according to the present invention is shown wherein the modified riding board 1010 includes a rotatable chassis 1012 with a single rear wheel mount 1082 similar to the rotatable chassis described above but without an engine assembly, and a front axle assembly 1092 with two wheels 1090*a* and *b* coupled with the rotatable chassis via a pivot assembly 1094. The front axle assembly 1092 and pivot assembly 1094 are similar to those described above; however, because there is no engine assembly, the pivot assembly for the modified riding board 1010 can be positioned somewhat lower than the pivot assembly for the riding board described above. As a result, the hinged board assembly for the modified riding board, shown by phantom lines at 1020 in FIG. 11, is located closer to the ground than the board assembly 20 described above and is positioned forward of the rear wheel. The modified riding board 1010 is also shown with a hand control assembly 1024 similar to that described above for operating the brake.

Figure 12:
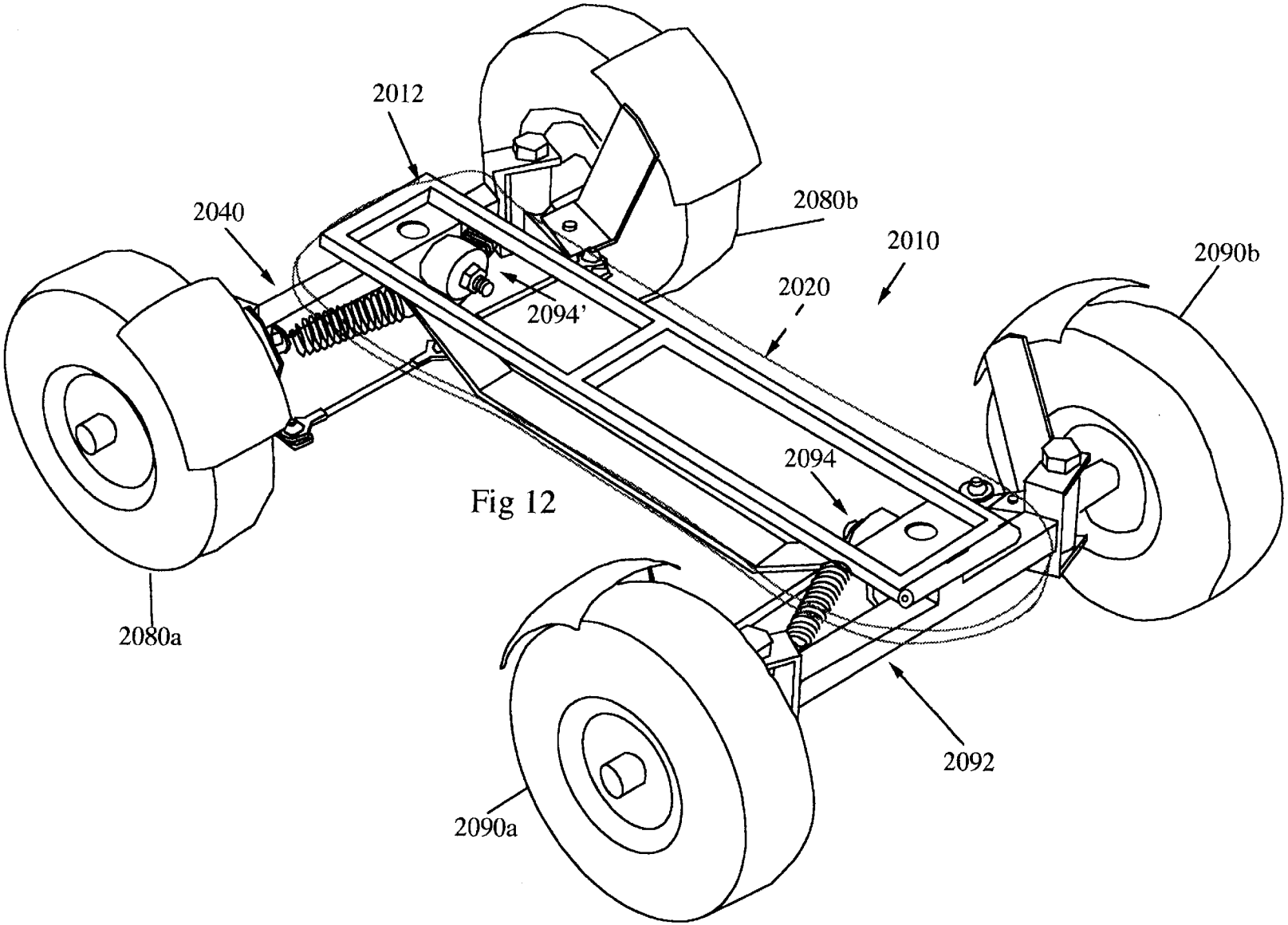
FIG. 12 is a front perspective view of another modification of the multi-terrain riding board according to the present invention.

Another modification of the riding board according to the present invention is shown in FIG. 12 wherein the modified riding board 2010 includes a rotatable chassis 2012 without an engine assembly, a front axle assembly 2092 with two wheels 2090*a* and *b* similar to the front axle assembly 1092, and a rear axle assembly 2040 with two wheels 2080*a* and *b* similar to the front axle assembly, the front and rear axle assemblies being coupled with the rotatable chassis assembly via pivot assemblies 2094 and 2094', respectively. Rotatable chassis 2012 is similar to chassis assembly 1012 but does not include a single rear wheel mount. Instead, the rear end of the chassis resembles the front end of the chassis and is coupled with rear axle assembly 2040 via pivot assembly 2094' which, like pivot assembly 2094 at the front of the board, is similar to pivot assembly 1094 described above. A hinged board assembly 2020 is shown in phantom in FIG. 12 and is similar to board assembly 20 described above in that it extends over the rear axle between the rear wheels.

Figure 13:
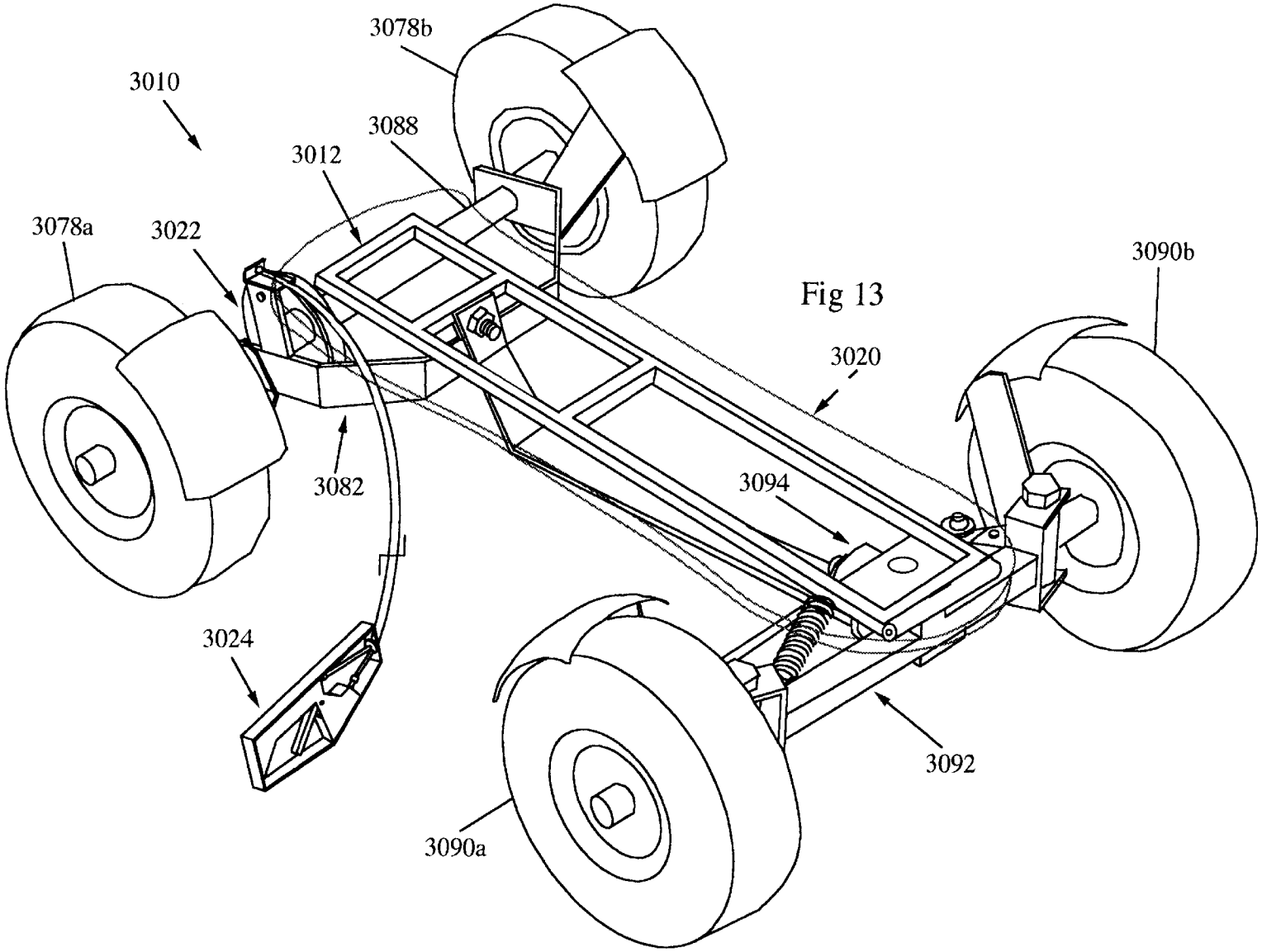
FIG. 13 is a front perspective view of still another modification of the multi-terrain riding board according to the present invention.

The modified riding board 3010 shown in FIG. 13 includes a front axle assembly 3092 with two wheels 3090*a* and *b* similar to the front axle assembly 1092 described above, a rotatable chassis 3012 similar to the rotatable chassis 1012 described above but with a rear wheel mount 3082 configured to mount a pair of wheels 3078*a* and *b* on an axle 3088 so that the riding board has a total of four wheels, and a pivot assembly 3094 coupling the front axle assembly with the rotatable chassis. Riding board 3010 also differs in that the rear wheel axle 3088 extends laterally outward from the rear wheel mount 3082 to position the rear wheels on opposite sides of the mount rather than within the mount. The hinged board assembly for the modified riding board, shown by phantom lines at 3020 in FIG. 13, is also located closer to the ground than the board assembly 20 described above. A brake mechanism 3022 and hand control 3024 similar to those described above are also shown.

It will be appreciated that the riding boards illustrated in FIGS. 11–13 can be modified to receive the engine assembly illustrated in FIGS. 1–10 or any other type of suitable engine assembly, for example by increasing the height of the board assembly as needed and adding appropriate engine mounts.

While a rear drum brake is shown as a braking mechanism for the riding board, it will be appreciated that any suitable type of braking mechanism can be used including, but not limited to, drum brakes and disk brakes implemented on any of the wheels. It will also be appreciated that the board can be hinged to the chassis adjacent the front or rear end of the chassis or even along one side of the chassis to provide access to the engine and other components of the riding board. Any type of hinge can be used to connect one end of the board to the chassis including, but not limited to, conventional piano hinges and flexible strips. The opposite or free end of the board can be detachably secured to the chassis in any conventional manner, for example using a linchpin, a bolt, magnets or Velcro™.

The board or deck of the riding board can be configured to resemble the deck of a conventional skateboard and can be formed of any suitable material including, but not limited to, reinforced and unreinforced plastics, metals, and wood. The deck can be of integral, one piece design or formed of multiple pieces, one or more of which can be hinged to the chassis. The deck can also be provided with various types of handles and cut-outs to facilitate grasping during use or in transporting the riding board.

The chassis can be formed of any suitable materials including, but not limited to, metals such as aluminum and steel, plastics, and reinforced plastics. The top support structure of the chassis can be configured as a frame made up of solid or hollow members or as a solid platform with cut-outs providing access to the engine assembly.

The dual lever hand control assembly shown and described above is merely exemplary of the types of the hand control assemblies that can be used. For example, a hand control assembly utilizing a butterfly lever could be used so that throttle is cut when braking and vice-versa.

While screws have been shown extending rearwardly in an outward direction from the front axle assembly to function as turn radius adjusters limiting the degree of rotation or turn radius of the front wheels, it will be appreciated that other types of stops and abutments can be used as turn radius adjusters including, but not limited to, manually adjustable posts projecting from the axle assembly or chassis in the path of rotation of the lugs or spindles, and walls encasing the swivel posts and including slots of adjustable circumferential length for the spindles.

The wheels can be of any conventional type but are preferably cast aluminum, plastic or steel with high-speed bearings. Any conventional tire can be used including, but not limited to, pneumatic tires with knobby or stud treads for off-road use. The tire size is dependent upon the ride quality desired and the amount of clearance required for the engine assembly but is preferably about ten inches in diameter.

In as much as the present invention is subject to many variations, modifications, and changes in detail, it is intended that all subject matter discussed above or shown in the accompanying drawings be interpreted as illustrative only and not be taken in a limiting sense.

What is claimed is:

1. A multi-terrain riding board comprising a front wheel assembly including a front axle assembly having first and second horizontally oriented spindles rotatable about respective first and second vertical axes and a pair of front wheels mounted for rotation about said first and second spindles;

a rear wheel assembly including a rear axle and a rear wheel rotatably mounted on said rear axle;

a chassis mounted on said front and rear wheel assemblies for tilting movement about a longitudinal axis, said chassis having front and rear ends;

an elongate deck mounted on said chassis to provide a platform upon which a rider can stand;

an engine mounted on said chassis beneath said deck;

first and second tie rods connected between said front end of said chassis and said first and second spindles to transfer tilting movement of said chassis into rotation of said first and second spindles about said first and second vertical axes so that said front wheels are turned in the direction of tilt.

2. A multi-terrain riding board as recited in claim 1 and further comprising a pair of horizontal tension springs connected between said front end of said chassis and said front axle assembly adjacent said first and second spindles to assist in stabilizing said deck of the riding board.

3. A multi-terrain riding board as recited in claim 2 wherein said chassis includes vertically spaced top and bottom support structures, said elongate deck is mounted on said top support structure and said horizontal tension springs are connected between said bottom support structure and said front axle assembly.

4. A multi-terrain riding board as recited in claim 3 wherein said elongate deck includes an upper surface extending substantially the length of said chassis and wherein said engine is disposed between said top and bottom support structures of said chassis beneath said deck and between said front and rear axle assemblies.

5. A multi-terrain riding board as recited in claim 1 and further comprising a turn radius adjuster coupled with said first spindle to limit the degree of rotation of said first spindle about said first vertical axis.

6. A multi-terrain riding board as recited in claim 1 wherein said front axle assembly further includes first and second vertically oriented swivel posts having longitudinal axes aligned with said first and second vertical axes, wherein said swivel posts are mounted for rotation about said longitudinal axes and said first and second spindles extend transversely from said swivel posts.

7. A multi-terrain riding board as recited in claim 1 wherein said front axle assembly further includes first and second lugs extending rearwardly from said first and second swivel posts, and wherein said first and second tie rods extend between said front end of said chassis and said first and second lugs.

8. A multi-terrain riding board as recited in claim 7 and further comprising a turn radius adjuster in the form of a screw threadedly engaging said front axle assembly and extending rearwardly therefrom at an angle to be disposed in the path of rotation of said first lug.

9. A multi-terrain riding board as recited in claim 1 wherein said rear axle is fixedly connected to said chassis so that said rear wheel cambers in response to tilting of said deck.

10. A multi-terrain riding board as recited in claim 1 wherein said rear axle assembly is pivotally coupled with said chassis.

11. A multi-terrain riding board as recited in claim 10 wherein said rear axle assembly includes third and fourth horizontally oriented spindles rotatable about respective third and fourth vertical axes, and further comprising a pair of rear wheels rotatably mounted on said third and fourth spindles and third and fourth tie rods connected between said chassis and said third and fourth spindles to transfer tilting movement of said deck into rotation of said third and fourth spindles about said third and fourth vertical axes so that said wheels are turned away from the direction of tilt.

12. A multi-terain riding board as recited in claim 11 and further comprising a pair of horizontal tension springs connected between said rear end of said chassis and said rear axle assembly adjacent said third and fourth spindles to assist in stabilizing said deck of the riding board.

13. A multi-terrain riding board as recited in claim 12 wherein said rear axle assembly includes third and fourth vertically oriented swivel posts having longitudinal axes aligned with said third and fourth vertical axes, wherein said third and fourth swivel posts are mounted for rotation about said third and fourth longitudinal axes and said third and fourth spindles extend transversely from said swivel posts.

14. A multi-terrain riding board as recited in claim 1 wherein said chassis extends rearwardly of said elongate deck, and further comprising a handle mounted on said rear end of said chassis to permit a rider to pull or lift said riding board.

15. A multi-terrain riding board comprising a chassis having front and rear ends;

front and rear wheel assemblies coupled with said chassis adjacent said front and rear ends, respectively, such that at least one of said wheel assemblies turns in response to tilting of said chassis;

an engine assembly mounted within said chassis between said front and rear wheel assemblies; and a board assembly with a substantially horizontal elongate deck mounted on said chassis above said engine assembly to provide a platform upon which a rider can stand, and a hinge connecting said deck with said chassis at one end to permit an opposite free end of said deck to pivot from a lowered position resting on said chassis to an elevated position allowing access to said engine assembly.

16. A multi-terrain riding board as recited in claim 15 wherein said hinge includes a first component mounted underneath said deck and a second component mounted on said chassis, said first and second components mating to provide a hinged connection.

17. A multi-terrain riding board as recited in claim 15 wherein said hinge connects a front end of said deck with said front end of said chassis.

18. A multi-terrain riding board as recited in claim 15 and further comprising means for releasably latching said free end of said deck to said chassis in said lowered position.

19. A multi-terrain riding board as recited in claim 18 wherein said releasable latching means includes a bracket mounted underneath said deck adjacent said free end and a linchpin extending through said bracket and said chassis to prevent upward movement of said free end.

20. A multi-terrain riding board comprising a chassis having front and rear ends;

an elongate deck mounted on said chassis to provide a platform upon which a rider can stand;

a front axle assembly with first and second horizontally oriented spindles rotatable about respective first and second vertical axes;

a pair of wheels mounted for rotation about said first and second spindles;

a pivot assembly including a pivot bolt fixed to said front axle assembly and extending through said chassis, and a bushing disposed around said pivot bolt and held in compression against said chassis to resist tilting of said chassis relative to said front axle assembly;

first and second tie rods connected between said front end of said chassis and said first and second spindles to transfer tilting movement of said deck into rotation of said first and second spindles about said first and second vertical axes so that said front wheels are turned in the direction of tilt;

a rear axle assembly including a rear axle coupled with said rear end of said chassis; and a rear wheel rotatably mounted on said rear axle.

* * * * *